US010024137B2

(12) United States Patent
Schultz et al.

(10) Patent No.: US 10,024,137 B2
(45) Date of Patent: Jul. 17, 2018

(54) COMPACT DISTRIBUTED SUBSEA DISTRIBUTION OF HYDRAULIC POWER AND CHEMICAL INJECTION

(71) Applicant: Oceaneering International, Inc., Houston, TX (US)

(72) Inventors: Earl Schultz, Spring, TX (US); Benjamin Primm, Houston, TX (US); Matthew Smith, Houston, TX (US)

(73) Assignee: OCEANEERING INTERNATIONAL, INC., Houston, TX (US)

( * ) Notice: Subject to any disclaimer, the term of this patent is extended or adjusted under 35 U.S.C. 154(b) by 0 days.

(21) Appl. No.: 15/474,926

(22) Filed: Mar. 30, 2017

(65) Prior Publication Data

US 2017/0284172 A1 Oct. 5, 2017

Related U.S. Application Data

(60) Provisional application No. 62/315,435, filed on Mar. 30, 2016.

(51) Int. Cl.

| | |
|---|---|
| ***E21B 41/00*** | (2006.01) |
| ***G05D 1/00*** | (2006.01) |
| ***E21B 34/00*** | (2006.01) |
| ***E21B 41/04*** | (2006.01) |

(52) U.S. Cl.

CPC ..... *E21B 34/00* (2013.01); *E21B 41/04* (2013.01)

(58) Field of Classification Search

CPC .... E21B 41/0007; E21B 34/00; G05D 1/0011

See application file for complete search history.

(56) References Cited

U.S. PATENT DOCUMENTS

| | | | | |
|---|---|---|---|---|
| 3,301,322 | A * | 1/1967 | Newsome | A01B 39/26 166/339 |
| 4,915,419 | A * | 4/1990 | Smith, III | E21B 41/0007 285/124.3 |
| 8,066,076 | B2 * | 11/2011 | Donald | E21B 33/035 166/344 |
| 2009/0025936 | A1 * | 1/2009 | Donald | E21B 33/035 166/344 |

(Continued)

*Primary Examiner* — James G Sayre

(74) *Attorney, Agent, or Firm* — Maze IP Law, PC

(57) ABSTRACT

A subsea fluid distributor comprises a support framework removably mountable and hydraulically connectable to a subsea structure intermediate the subsea structure and an incoming flying lead's terminator; a plate attached to an upper section of the support framework; a fixed bucket and a valve attached to the support framework; a lower framework attached to a lower portion of the support framework; a first hydraulic tube, in fluid communication with the valve, attached to the lower framework; a flying lead junction plate support framework attached to the lower portion of the support framework; a second hydraulic tube, in fluid communication with various subsea equipment, disposed at least partially within the flying lead junction plate support framework; a first remotely operated vehicle (ROV) torque bucket attached to an upper portion of the flying lead junction plate support framework; and a second ROV torque bucket attached to the upper section of the support framework.

13 Claims, 2 Drawing Sheets

(56) References Cited

U.S. PATENT DOCUMENTS

| | | | | |
|---|---|---|---|---|
| 2010/0119380 | A1* | 5/2010 | Wilson | E21B 41/0007 417/53 |
| 2012/0111572 | A1* | 5/2012 | Cargol, Jr. | E21B 33/0355 166/363 |
| 2012/0273214 | A1* | 11/2012 | Donald | E21B 33/035 166/344 |
| 2014/0027123 | A1* | 1/2014 | Organ | E21B 33/0355 166/339 |
| 2016/0265313 | A1* | 9/2016 | Taylor | B63C 11/52 |
| 2017/0204704 | A1* | 7/2017 | Sommerfield | E21B 41/0007 |

* cited by examiner

COMPACT DISTRIBUTED SUBSEA DISTRIBUTION OF HYDRAULIC POWER AND CHEMICAL INJECTION

RELATION TO PRIOR APPLICATIONS

This application claims the benefit of U.S. Provisional Patent Application 62/315,435 titled "Compact Distributed Subsea Distribution of Hydraulic Power and Chemical Injection" filed on Mar. 30, 2016.

BACKGROUND OF THE INVENTION

Subsea oil and gas production wells typically require hydraulic power for opening valves and chemical treatment to help ensure the reservoir; production tubing, valves and pipelines remain in optimum condition for well flow and pressure integrity. These services are typically delivered from a host facility to a subsea well via an umbilical. Where multiple wells are served from a single umbilical, the hydraulic and chemical services must be distributed among them, either within a termination unit directly connected to the umbilical, often called an umbilical termination assembly (UTA), or within a distribution unit, often called a subsea distribution unit (SDU) or hydraulic distribution manifold (HDM), connected to the umbilical termination via jumpers, usually called flying leads. Subsea connection of the hydraulic and chemical lines are made using specialized hydraulic connectors, often referred to as junction plates, stab plates or multi-quick connector (MQC) plates, in which one or more pairs of hydraulic couplings are mated together simultaneously using a mechanical mating mechanism.

Additionally, it is possible to distribute chemicals from a single umbilical tube to multiple subsea injection points via the use of specialized subsea valves, often referred to as chemical injection metering valves (CIMV) or chemical throttling valves (CTV). These valves are typically pre-installed onto subsea equipment prior to being installed or deployed.

DESCRIPTION OF THE DRAWINGS

The figures supplied herein illustrate various embodiments of the invention.

DESCRIPTION OF EXEMPLARY EMBODIMENTS

In general, the claimed invention incorporates distribution functions within a small structure that is placed between the end of a flying lead and a piece of subsea equipment. The structure comprises an incoming (sometimes referred to as "fixed") plate for the incoming flying lead, an out-going plate (sometimes referred to as "removable") to the subsea equipment, and an additional incoming (fixed) plate to accommodate a second outgoing flying lead to connect to an addition piece of subsea equipment. Within the structure, common hydraulic lines are distributed from the incoming flying lead to both of the other junction plates. Chemicals for performing various functions may pass through an integral chemical valve (CIMV or CTV).

In its various uses, the subsea fluid distributor allows for connection of additional wells or other subsea equipment beyond that originally intended; incorporation of CIMV/CTV's without pre-installation on subsea equipment; reduction in size of subsea distribution equipment such as UTAs, SDUs, and/or HDMs; and the like; or a combination thereof.

Figure 1:
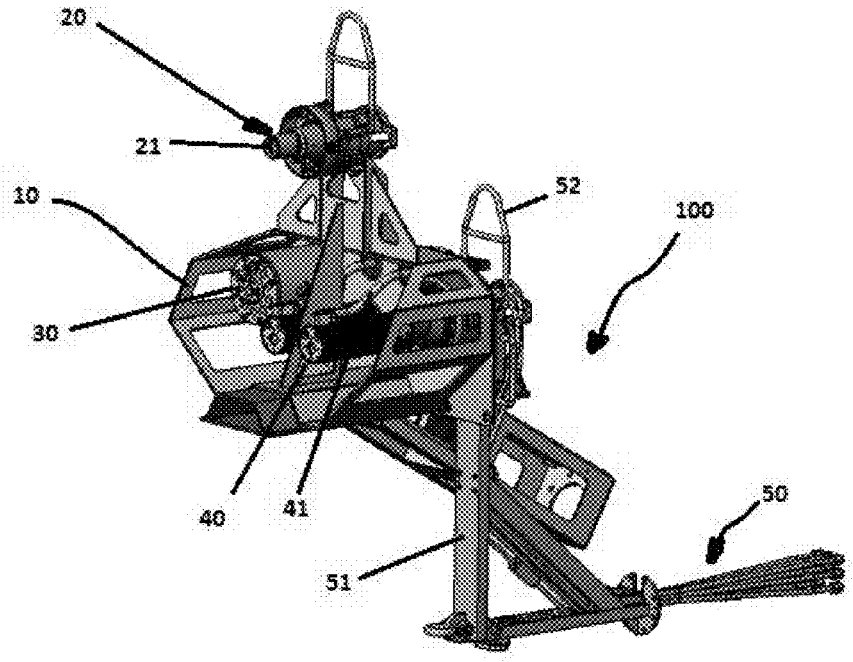
FIG. 1 is first view in partial perspective of an exemplary embodiment of the invention.
Figure 2:
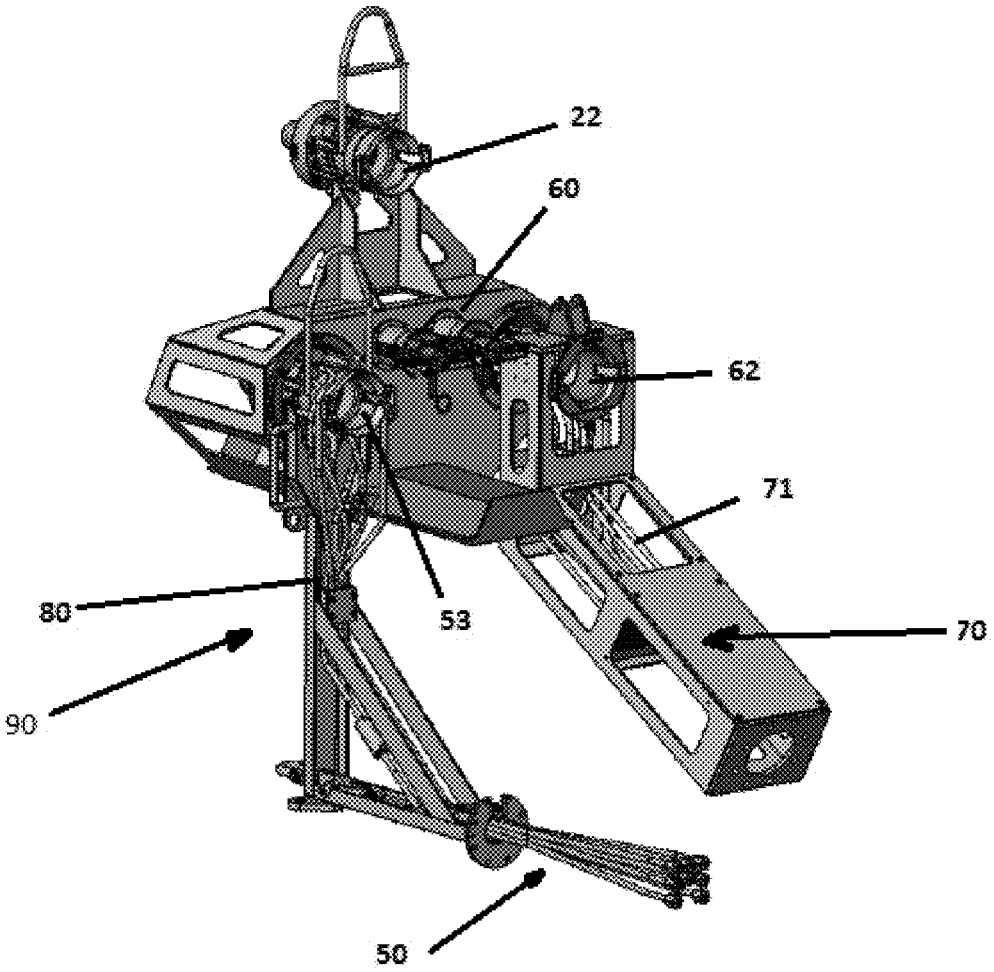
FIG. 2 is a second view in partial perspective of an exemplary embodiment of the invention.

Referring to FIGS. 1 and 2, subsea fluid distributor 100 comprises support framework 10 configured to be removably mounted to a subsea structure (not shown in the figures) intermediate the subsea structure and one or more incoming flying lead assemblies 70,80 of an incoming flying lead (not shown in the figures) and to allow for hydraulic connections; plate 20 attached to an upper section of support framework 10; fixed bucket 30 attached to support framework 10; one or more chemical injection valves 40 attached to support framework 10; lower framework 51 attached to a lower portion of support framework 10; one or more first hydraulic tubes 81 attached to lower framework 51 and in fluid communication with valve 40; flying lead junction plate support assembly 70 (FIG. 2) attached to the lower portion of support framework 10; one or more second hydraulic tubes 71 disposed at least partially within flying lead junction plate support assembly 70 and in fluid communication with various subsea equipment; first remotely operated vehicle (ROV) compatible torque bucket 62 attached to an upper portion of flying lead junction plate support assembly 70; second ROV compatible torque bucket 22 (FIG. 2) attached to the upper section of support framework 10; and a predetermined set of signal connectors 60 attached to the upper section of support framework 10 and operatively connected to an electric control module ?? to aid in controlling the operation of valve 40. As one of ordinary skill in these subsea arts will understand, first hydraulic tube 81 may comprise a plurality of hydraulic tubes 81 and second hydraulic tube 71 may comprise a plurality of second hydraulic tubes 71.

Flotation attachment junction 52 may be present and attached to the upper section of support framework 10.

Plate 20 may comprise a removable multi-quick connector (MQC) plate.

Valve 40 may comprise one or more chemical injection metering valves, one or more chemical throttle valves, or the like, or a combination thereof. In addition, valve 40 may be in fluid communication with a chemical line as desired.

Subsea fluid distributor 100 typically further comprises one or more incoming receptors 80, which may be hydraulic incoming receptors and/or chemical incoming receptors, and one or more outgoing channel distributors 53 in fluid communication with at least one incoming receptor 80. Subsea fluid distributor 100 may also be in communication with one or more pieces of subsea equipment and/or out-going flying leads (not shown in the figures).

Outgoing channel distributor 53 may be present and in fluid communication with one or more hydraulic incoming receptors 80 (FIG. 2) and/or chemical incoming receptors 80 (FIG. 2), a piece of subsea equipment (not shown in the figures), an out-going flying lead (not shown in the figures), or the like, or a combination thereof.

A hydraulic distribution manifold (HDM) (not shown in the figures) may be attached to support framework 10 and operatively placed in fluid communication with any number of lines in the assembly. The HDM is typically attached to support framework 10 proximate valve 40.

Similar to hydraulic and chemical flying lead assemblies 70,80, incoming flying lead assembly 80 and outgoing flying lead receiver 70 may each further comprise electrical assembly (not shown in the figures) which is directly mounted or terminated at one end of a flying lead.

The predetermined set of flying lead assemblies 80 typically comprises a first subset of incoming fluid flying leads 80 and second subset of outgoing fluid flying leads 70.

In the operation of exemplary embodiments, subsea fluid may be distributed via a subsea fluid distributor 100, which is as described above, by disposing support framework 10 intermediate a subsea structure not shown in the figures and one or more incoming flying lead assemblies 70,80 of an incoming flying lead 80. Incoming flying lead 80 is connected to subsea fluid distributor 100 and outgoing flying lead assembly 70. Fluid is provided through subsea fluid distributor 100 from incoming flying lead 80 to outgoing flying lead assembly 70.

In certain embodiments, one or more outgoing flying lead assemblies 70,80 are daisy chained from a first subsea fluid distributor 100 to incoming flying lead assembly 80 of a second subsea fluid distributor 100.

In certain embodiments the subsea fluid distributor 100 is provided with an integral valve 40 and chemical fluid passed through integral valve 40 to perform a function such as dosing chemicals at specific rates into subsea equipment. By way of example and not limitation, valve 40 may be an integral chemical valve used to supply fluid to subsea equipment that does not have a chemical valve pre-installed on that subsea equipment.

The foregoing disclosure and description of the inventions are illustrative and explanatory. Various changes in the size, shape, and materials, as well as in the details of the illustrative construction and/or an illustrative method may be made without departing from the spirit of the invention.

We claim:

1. A subsea fluid distributor, comprising:

a. a support framework configured to be removably mounted to a subsea structure intermediate the subsea structure and an incoming flying lead terminator of an incoming flying lead;

b. a plate attached to an upper section of the support framework;

c. a fixed bucket attached to the support framework;

d. a valve attached to the support framework;

e. a lower framework attached to a lower portion of the support framework;

f. a first hydraulic tube attached to the lower framework, the first hydraulic tube in fluid communication with the valve;

g. a flying lead junction plate support framework attached to the lower portion of the support framework;

h. a second hydraulic tube disposed at least partially within flying lead junction plate support framework, the second hydraulic tube in fluid communication with a predetermined subsea equipment;

i. a first remotely operated vehicle (ROV) torque bucket attached to an upper portion of the flying lead junction plate support framework; and j. a second ROV torque bucket attached to the upper section of the support framework.

2. The subsea fluid distributor of claim 1, wherein the hydraulic tube comprises a plurality of hydraulic tubes.

3. The subsea fluid distributor of claim 1, wherein the second hydraulic tube comprises a plurality of second hydraulic tubes.

4. The subsea fluid distributor of claim 1, further comprising a flotation attachment junction attached to the upper section of the support framework.

5. The subsea fluid distributor of claim 1, wherein the valve comprises a chemical injection metering valve or a chemical throttle valve.

6. The distribution structure of claim 1, wherein the fluid distributor further comprises:

a. an incoming receptor; and b. an outgoing channel distributor in fluid communication with the incoming receptor.

7. The subsea fluid distributor of claim 6, wherein the incoming receptor comprises a hydraulic incoming receptor or a chemical incoming receptor.

8. The subsea fluid distributor of claim 1, wherein the plate comprises a removable multi-quick connector (MQC) plate.

9. The subsea fluid distributor of claim 1, further comprising a predetermined set of signal connectors attached to the upper section of the support framework.

10. A method of subsea fluid distribution for a subsea fluid distributor comprising a support framework configured to be removably mounted to a subsea structure intermediate the subsea structure and an incoming flying lead terminator of an incoming flying lead; a plate attached to an upper section of the support framework; a fixed bucket attached to the support framework; a valve attached to the support framework; a lower framework attached to a lower portion of the support framework; a first hydraulic tube attached to the lower framework, the first hydraulic tube in fluid communication with the valve; a flying lead junction plate support framework attached to the lower portion of the support framework; a second hydraulic tube disposed at least partially within flying lead junction plate support framework, the second hydraulic tube in fluid communication with a predetermined subsea equipment; a first remotely operated vehicle (ROV) torque bucket attached to an upper portion of the flying lead junction plate support framework; and a second ROV torque bucket attached to the upper section of the support framework the method comprising:

a. disposing the support framework intermediate a subsea structure and an incoming flying lead terminator of an incoming flying lead;

b. connecting an incoming flying lead to the incoming flying lead connector;

c. connecting an outgoing flying lead to the outgoing flying lead connector; and d. providing a predetermined fluid through the distributor from the incoming flying lead to the outgoing flying lead.

11. The method of subsea fluid distribution for a subsea fluid distributor of claim 10, further comprising daisy-chaining an outgoing flying lead from a first subsea fluid distributor to an incoming flying lead of a second subsea fluid distributor.

12. The method of subsea fluid distribution for a subsea fluid distributor of claim 10, further comprising:

a. supplying the subsea fluid distributor with an integral chemical valve; and b. passing a chemical through the integral chemical valve to perform a predetermined function.

13. The method of subsea fluid distribution for a subsea fluid distributor of claim 12, further comprising using the integral chemical valve to supply fluid to a subsea equipment that does not have a chemical valve pre-installed on that subsea equipment.

* * * * *